US005568864A

United States Patent [19]

Nathan

[11] Patent Number: 5,568,864

[45] Date of Patent: Oct. 29, 1996

[54] SPOOL AND HOLDER FOR A ROLL DISPENSING BOX

[76] Inventor: Andrew R. Nathan, 51 Calvin Ave., Syosset, N.Y. 11791

[21] Appl. No.: 461,107

[22] Filed: Jun. 5, 1995

[51] Int. Cl.[6] ..... B65D 85/671

[52] U.S. Cl. ..... 206/408; 242/588.6; 242/599.3

[58] Field of Search ..... 242/588.6, 598.6, 242/599.3; 206/408, 389

[56] References Cited

U.S. PATENT DOCUMENTS

| | | | |
|---|---|---|---|
| 258,034 | 5/1882 | Earle | 242/588.6 |
| 1,342,909 | 6/1920 | Hope | 206/408 |
| 1,810,272 | 6/1931 | Goldbeek | 242/599.3 X |
| 1,967,676 | 7/1934 | Marchev | 242/599.3 X |
| 2,166,349 | 7/1939 | Fredd | 242/598.6 X |
| 2,215,053 | 9/1940 | Reese | 242/598.6 X |
| 2,922,516 | 1/1960 | Kessler | 206/408 |
| 3,667,597 | 6/1972 | Hollister . | |
| 4,231,475 | 11/1980 | Kessler | 206/389 |
| 4,445,645 | 5/1984 | Byer . | |
| 4,451,010 | 5/1984 | Meyer . | |
| 4,763,786 | 8/1988 | Benz | 206/408 |
| 4,905,923 | 3/1990 | Dudley . | |
| 5,143,316 | 9/1992 | Goetz et al. . | |

*Primary Examiner*—Bryon P. Gehman

*Attorney, Agent, or Firm*—Collard & Roe, P.C.

[57] ABSTRACT

A spool and holder for retaining a roll of sheeting material within a dispensing box. The holder consists of a pair of L-shaped brackets disposed at each end of the spool for engaging an end wall and two side walls of the box. The L-shaped brackets are slidably adjustable to accommodate different sized boxes. A wing nut is tightened along one end of the spool to keep the brackets in position against the box walls.

4 Claims, 1 Drawing Sheet

SPOOL AND HOLDER FOR A ROLL DISPENSING BOX

BACKGROUND OF THE INVENTION

1. Field of the Invention

The invention relates to a spool and holder for a dispensing box. More specifically, it relates to a spool and holder which clamps onto a dispensing box containing a roll of sheeting material, to prevent the box from splitting while the sheeting material is being dispensed.

2. The Prior Art

Various spool assemblies are known, according to the prior art, which maintain a roll of sheeting material within a dispensing box. These prior art patents retain the roll about its longitudinal axis within the box by keeping the roll from tilting in or popping out of the box. The prior art spool assembly patents are as follows: U.S. Pat. No. 3,667,597 to Hollister; U.S. Pat. 4,445,645 to Byer; U.S. Pat. 4,451,010 to Meyer; U.S. Pat. 4,905,923 to Dudley; and U.S. Pat. 5,143,316 to Goetz et al. Although these prior art patents suffice to maintain the roll within the dispensing box, they all suffer from a serious drawback. Because the dispensing boxes are frequently made of lightweight paper or cardboard, the various forces imposed on the box cause them to split or rip before all of the sheeting material is dispensed.

SUMMARY OF THE INVENTION

It is, therefore, an object of the present invention to overcome the drawbacks of the prior art and to provide a spool and holder which properly supports a dispensing box for sheeting material.

It is a further object of the present invention to provide a spool and holder which is adjustable to support dispensing boxes of various sizes.

These and other related objects are achieved according to the invention by a device adapted for retaining a roll of sheeting material within a dispensing box having two end walls and side walls. The device consists of a rod having a first end and a spaced opposite second end. The rod is adapted to extend through the roll and the box end walls. The device further includes adjustable retaining means disposed at each end of the rod for engaging an end wall and two of the side walls of the box to prevent the box from splitting while dispensing the sheeting material. The device further includes a nut which rotatably engages a cooperatively threaded end of the rod. The nut tightens the retaining means against the box end walls. The device also includes a cotter pin which extends through an aperture in the other end of the rod. A washer is then placed onto the rod between the cotter pin and the retaining means.

The retaining means consists of a pair of L-shaped brackets at each end of the rod. Each L-shaped bracket has one leg disposed adjacent the box end wall with an opening formed therein for receiving the rod. Each L-shaped bracket also includes another leg for engaging one of the box side walls. One of the pair of brackets includes a projection spaced from the opening. The opening on the other of the pair of brackets is a slot-shaped opening extending in a longitudinal direction. The slot-shaped opening is dimensioned and oriented to accommodate the projection and extend over the opening of the one bracket. The pair of brackets are slidingly adjustable relative to each other in the longitudinal direction. The pair of brackets engage two opposite side walls of the box and are slidingly adjustable to clamp differently sized boxes therebetween.

BRIEF DESCRIPTION OF THE DRAWING

Other objects and features of the present invention will become apparent from the following detailed description considered in connection with the accompanying drawing which discloses an embodiment of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF THE PREFERRED EMBODIMENT

Figure 1:
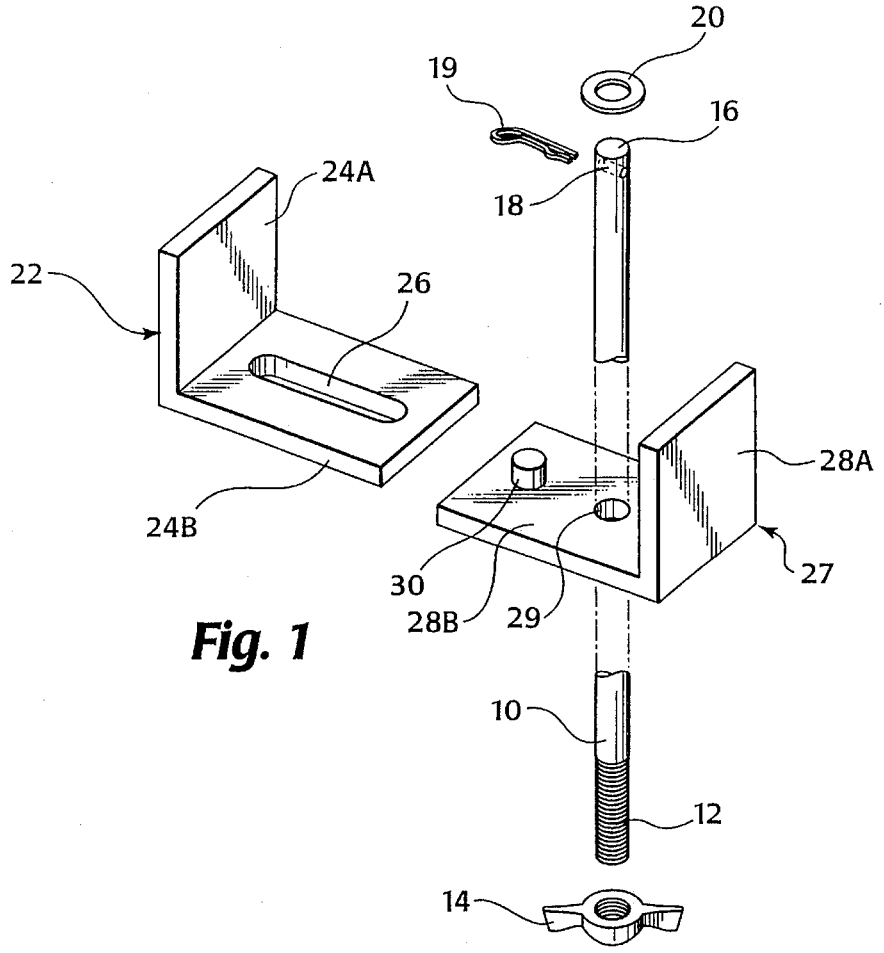
FIG. 1 is an exploded perspective view of the rod and one pair of brackets according to the invention.

Referring now in detail to the drawings and, in particular, FIG. 1, there is shown a spool or rod 10 having a first end 12 cooperatively threaded to engage a wing nut 14. Rod 10 further includes a second end 16 provided with an aperture 18 for receiving a cotter pin 19 to hold washer 20 on rod 10. An inner bracket 22 includes a first leg 24*a* and a second leg 24*b* equipped with a longitudinally-extending slot 26. An outer bracket 27 also includes a first leg 28*a* and a second leg 28*b* equipped with an aperture 29 and a projection 30. Projection 30 has a cylindrical shape and a diameter approximately equal to the diameter of rod 10. Slot 26 has a length exceeding the distance between aperture 29 and projection 30. Slot 26 has a width slightly larger than the diameter of projection 30 and rod 10. Second leg 24*b* is laid flat on top of second leg 28*b* with slot 26 receiving projection 30 and being aligned with aperture 29. With rod 10 in place, inner bracket 22 is slidably disposed with respect to outer bracket 27 in the direction of elongation of slot 26.

Figure 2:
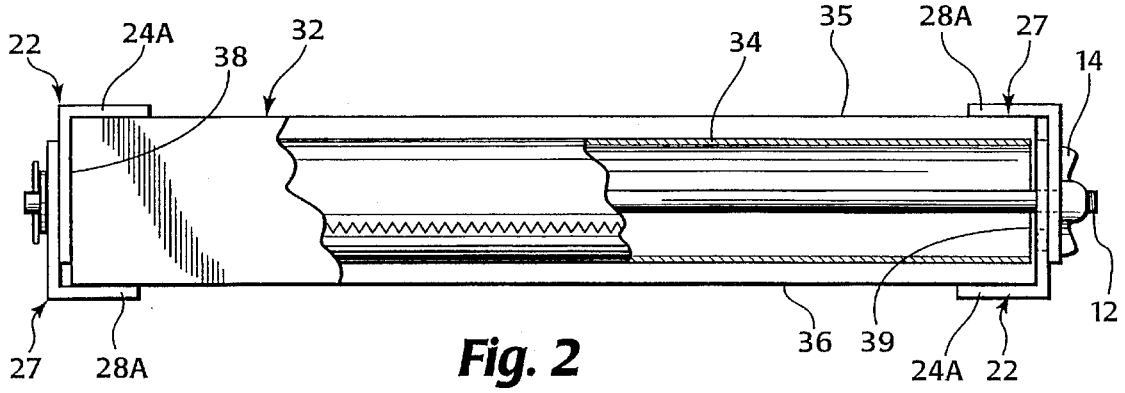
FIG. 2 is a front side elevational view, in part cross-section, showing the rod and both pairs of clamps installed on a dispensing box for sheeting material.

As can be seen in FIG. 2 a box 32 contains a roll of sheeting material 24, for example, aluminum foil or plastic wrap. Box 32 includes a left end wall 38 and a right end wall 39. Four exterior side walls extend between end walls 38 and 39 to form a rectangular cube. Two of the four side walls constitute a pair of opposed exterior walls 35 and 36. The spool and holder according to the invention are installed on box 32 as follows: an inner bracket 22, an outer bracket 27 and washer 20 are placed over end 16 onto rod 10 and retained on rod 10 by cotter pin 19. Threaded end 12 of rod 10 then pierces the left end wall 38 of box 32, passes through the center of roll 34 and emerges by piercing through the right end wall 39 of box 32. Projection 30 is aligned with slot 26 and both brackets 22 and 27 are pressed against the left end wall of box 32 by rod 10, cotter pin 19 and washer 20. Brackets 22 and 27 are then slid toward each other until legs 24*a* and 28*a* clamp onto walls 35 and 36. As can be appreciated, slot 26 extends longitudinally between opposed side walls 35 and 36 to allow brackets 22 and 27 to slide toward each other and engage side walls 35 and 36. A further inner bracket 22 and outer bracket 27 are then slipped over threaded end 12. Wing nut 14 is loosely threaded onto end 12. Projection 30 is aligned with slot 26 and brackets 22 and 27 are slid together until legs 28*a* and 24*a* clamp onto walls 35 and 36. Wing nut 14 is then tightened to maintain both pairs of brackets 22 and 27 in place.

Wing nut 14 is tightened along threaded end 12 to secure both pairs of brackets 22 and 27 against end walls 38 and 39. This securing force keeps the brackets 22 and 27 of each pair in position relative to each other so that they can securely clamp onto opposed side walls 35 and 36. While rod 10 prevents roll 34 from being pulled out of box 32, brackets 22 and 27 reinforce opposed side walls 35 and 36 to prevent the box from splitting or ripping during dispensing of the sheeting material. Brackets 22 and 27 are adjustable with respect to each other so that boxes of different sizes can be accommodated. For example, for larger boxes, rod 10 need not pass through slot 26. Rod 10 may be threaded along several inches to accommodate boxes of various lengths.

While only a single embodiment of the present invention has been shown and described, it is to be understood that many changes and modifications may be made thereunto without departing from the spirit and scope of the invention as defined in the appended claims.

What is claimed is:

1. A device adapted for retaining a roll of sheeting material in a box having two end walls and side walls comprising:

a rod mean having a first threaded end, a cooperatively threaded nut, and a spaced opposite second end, said rod being adapted to extend through the roll and the box end walls; and adjustable retaining means comprising a pair of L-shaped brackets coupled to each end of said rod, each L-shaped bracket having one leg adapted for placing adjacent a box end wall with an opening formed therein for receiving said rod and another leg adapted for engaging one of the box side walls, wherein said nut is adapted to tighten said L-shaped brackets against the box end and side walls to prevent the box from splitting while dispensing the sheeting material.

2. A device for retaining a roll of sheeting material in a box having two end walls and side walls comprising:

a rod including a first threaded end and a spaced opposite second end having an aperture therethrough, said rod being adapted to extend through the box end walls and the roll;

adjustable retaining means coupled to each end of said rod and adapted for engaging an end wall and two of the side walls of the box, said adjustable retaining means comprising a pair of L-shaped brackets at each end of said rod, each L-shaped bracket having one leg adapted for placing adjacent a box end wall with an opening formed therein for receiving said rod and another leg adapted for engaging one of the box side walls;

a cotter pin received within the aperture and a washer placed onto said second end of said rod between said cotter pin and said retaining means; and a nut cooperatively threaded to rotatably engage said first threaded end, wherein said nut is adapted to tighten said retaining means against the two end walls to prevent the box from splitting while dispensing the sheeting material.

3. The device according to claim 2, wherein one bracket of said pair of brackets includes a projection spaced from the opening;

wherein the opening on the other bracket of said pair of brackets is a slot-shaped opening extending in a longitudinal direction, the slot-shaped opening is dimensioned and oriented to accommodate said projection and extend over the opening of said one bracket so that said pair of brackets are slidingly adjustable relative to each other in the longitudinal direction.

4. The device according to claim 3, wherein said pair of brackets are adapted to engage two opposite side walls of the box and to adjustably clamp differently sized boxes therebetween.

* * * * *